US006374915B1

(12) United States Patent
Andrews

(10) Patent No.: US 6,374,915 B1
(45) Date of Patent: Apr. 23, 2002

(54) PROCESS AND APPARATUS FOR SEALING ABANDONED WELL BORES

(76) Inventor: William Andrews, W4234 State Rd. 54, Black Creek, WI (US) 54106

( * ) Notice: Subject to any disclaimer, the term of this patent is extended or adjusted under 35 U.S.C. 154(b) by 0 days.

(21) Appl. No.: 09/585,167

(22) Filed: Jun. 1, 2000

(51) Int. Cl.[7] ..... E21B 33/13

(52) U.S. Cl. ..... 166/292; 166/75.15; 166/286; 405/179

(58) Field of Search ..... 405/179; 166/75.15, 166/267, 249, 286, 292; 175/88, 207

(56) References Cited

U.S. PATENT DOCUMENTS 4,696,607 A * 9/1987 Ressi di Cervia ..... 405/267
4,955,756 A * 9/1990 Klamar ..... 405/179
5,199,574 A * 4/1993 Hollyfield, Jr. et al. ..... 209/315
5,259,699 A * 11/1993 Klamar ..... 405/179

* cited by examiner

*Primary Examiner*—David Bagnell
*Assistant Examiner*—Zakiya Walker
(74) *Attorney, Agent, or Firm*—Ryan Kromholz & Manion, S.C.

(57) ABSTRACT

Apparatus and process for sealing of abandoned water well bores includes a hopper for dispensing comminuted well bore packing material such as a bentonite clay onto an inclined screening surface which removes undesired fine materials. A chute for collecting material flowing off of the screening surface and directing the same into the well bore is generally funnel shaped. The apparatus includes an eccentric vibrating mechanism for vibrating the inclined screening surface to remove the undesired fine materials.

2 Claims, 2 Drawing Sheets

PROCESS AND APPARATUS FOR SEALING ABANDONED WELL BORES

This invention relates to apparatus and processes for permanently sealing abandoned well bores. More particularly, the invention relates to such apparatus and procedures used to seal abandoned water wells.

BACKGROUND OF THE INVENTION

Refilling or sealing up of abandoned water well bores is generally mandated by governmental statutes and regulations. Usually the various state Departments of Natural Resources also regulate and specify the types of material which must be introduced into the abandoned well in order to properly seal the same as well as procedures which are acceptable for such purposes. Such sealing of well bores is necessary in order to prevent surface water from entering underground aquifers from which drinking water is drawn and also due to safety concerns.

The typical regulations involved require that a material, usually a clay such as bentonite, be used to reseal the well bores. However, such materials generally must be first screened in order to avoid introduction into the aquifer of very fine materials which could interrupt or contaminate underground waterflow channels.

No suitable apparatus has been available, commercially, to fill the need for such apparatus. The procedures utilized heretofore have been painstaking, involving tedious manual operations using various hand tools. Thus, a substantial need has existed for improved procedures and apparatus which would facilitate sealing of abandoned well bores.

SUMMARY OF THE INVENTION

An important object of the invention is to provide improved apparatus for efficiently sealing abandoned well bores, especially those resulting from abandonment of water wells. A related object is to provide improved procedures, utilizing the apparatus, for sealing of such unused or abandoned well bores. As used herein, "well bore", is intended to include the open shaft of a well whether or not a casing is contained therein.

In accordance with one aspect of the invention, the process involves the introduction of comminuted bentonite into a hopper out of which the flow of material is regulated by means of a suitable flow control mechanism. In accordance with another related aspect, the material flows from the hopper down an inclined screening surface which removes undesired fine materials prior to feeding the mixture, such as bentonite, into the well bore.

In accordance with a further aspect of the invention, a vibrating mechanism, usually employing an eccentric vibration causing means, is used to vibrate the inclined screen in order to efficiently cause separation of the fine materials from the blend which is used. Another advantage of the invention is that the vibrating mechanism also helps to efficiently cause flow of the materials out of the hopper onto the screening surface.

In accordance with still a further aspect of the invention, a collecting and distributing chute is provided at the bottom of the inclined screening surface to collect, and divert into the well bore, the screened clay materials which are used to reseal the well bore, and to efficiently direct the same into the well bore.

In accordance with further aspects of the invention, the apparatus is compact and transportable. The apparatus includes adjustable and collapsible supporting legs which can be folded against the main body of the apparatus for easy transportation thereof.

Further objects and advantages of the invention will be apparent from the following claims and detailed description of the preferred embodiment, and by the accompanying drawings.

DETAILED DESCRIPTION OF THE INVENTION

Figure 2:
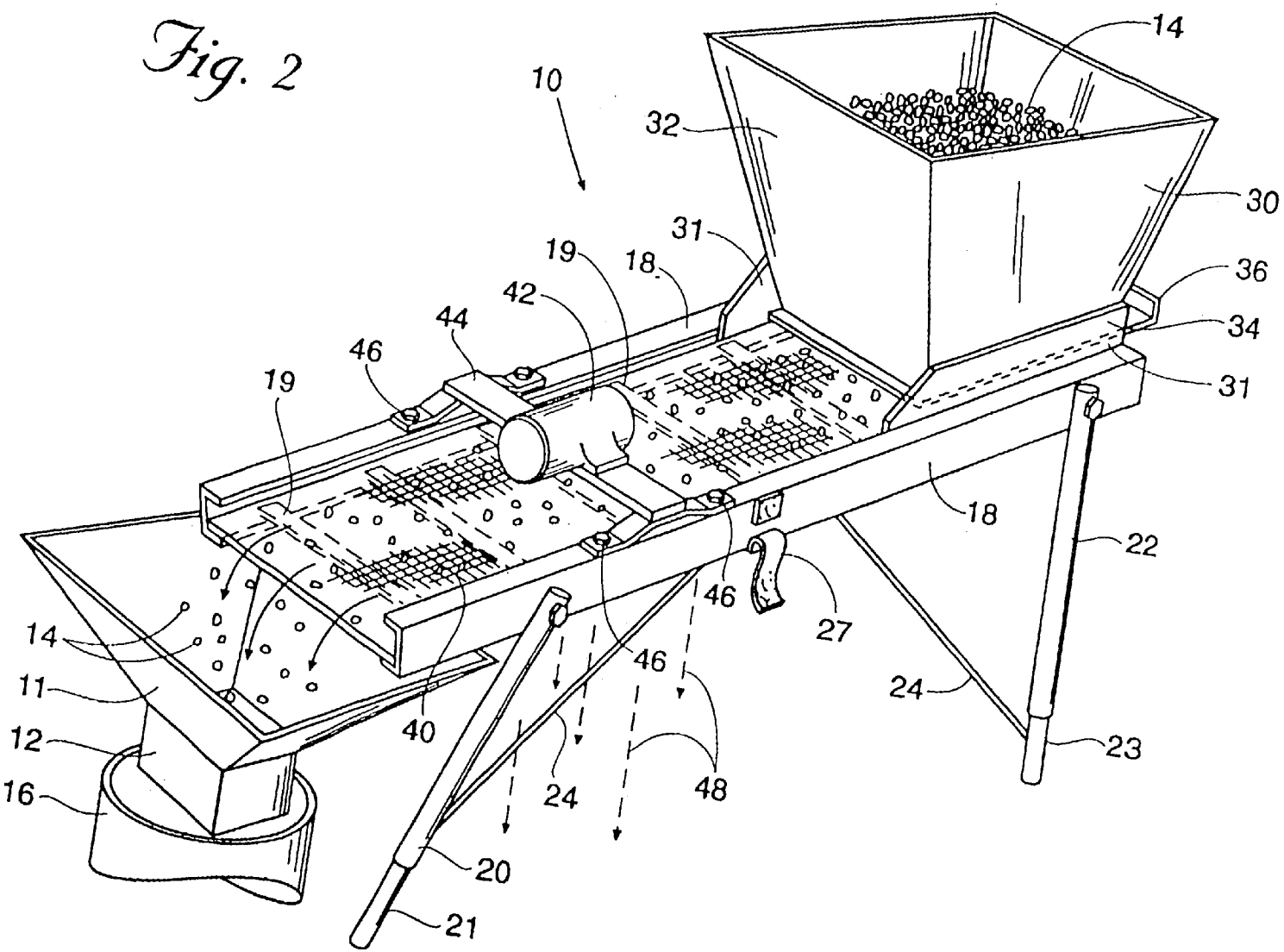

The apparatus of this invention is generally indicated by numeral 10. As seen, the apparatus includes flow directing apparatus in the form of a generally funnel shaped collecting/flow directing receptacle 11. The collecting portion of the funnel-shaped flow director 11, as best seen in FIG. 2, is preferably of a rectangular configuration, and narrows to a lower portion 12 adapted to direct the flow of particles of a well bore resealing material, such as bentonite 14. As seen, the bentonite is directed, as indicated by arrows, into the well bore 16.

Also, referring to the drawings, it is seen that the main body of the apparatus 10 is supported by a pair of side frame beams 18 connected by a plurality of supporting cross-members 19. As shown, the side beams or rails 18 are formed of a C-shaped configuration, but it should be understood that other configurations may be substituted. Also, while the funnel-shaped flow director 11, 12 is shown to be rectangular in configuration, it will be apparent to those skilled in the art that these components can be of other configurations, for example, circular.

The side frame members 18 are supported by adjustable front legs 20 and rear legs 22, which are pivotally connected to side frame members 18 and which are preferably formed of a telescoping configuration so that the length thereof can be adjusted to adapt to various slopes and irregularities of the terrain surrounding the well.

Figure 1:
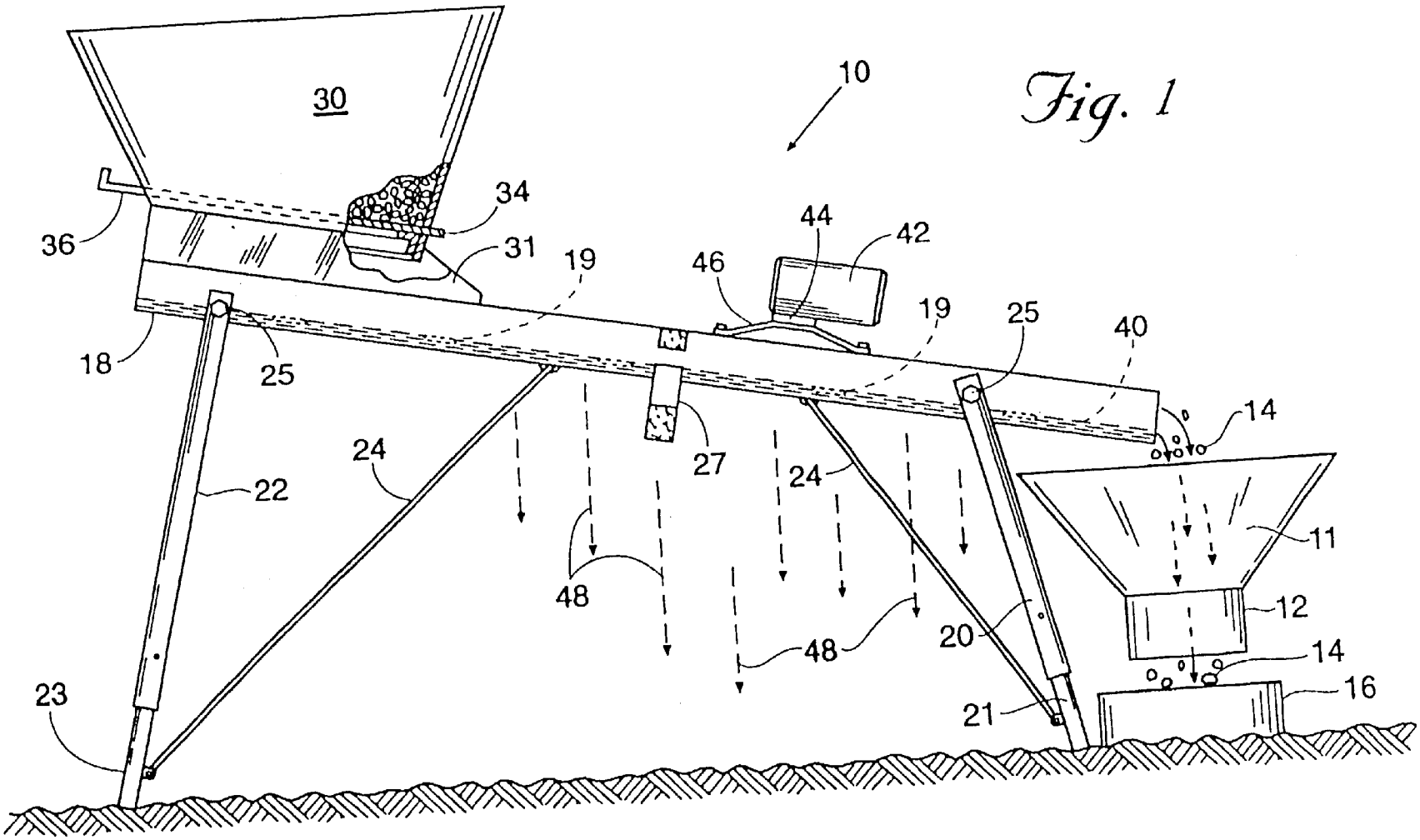
FIG. 1 is a side elevational view of the preferred apparatus of the invention; and, FIG. 2 is a perspective view of the apparatus shown in FIG. 1.

As best seen in FIG. 1, each of the legs 22 has a telescoping end 23 and the legs 20 have telescoping end sections 21 suitable for the purpose adjusting the apparatus 10 to the slope of the terrain on which it is used.

Each of the legs 20 and 22 is connected by a bolt 25, or similar fastener, to the side frame member 18, so that it is pivotable thereagainst. Thus, the legs 20 and 22 can each be folded toward each other for transportation and extended downwardly, as illustrated, for use. Preferably, each of the legs is provided with a cord or cable 24 which limits the pivoting of the legs 20 and 22, thereby stabilizing the structure of apparatus 10 during use.

Also as seen in the drawings, the apparatus 10 is provided with a material-feeding hopper 30 supported on the side rails 18 by suitable brackets 31. Hopper 30 into which the bentonite 14 or similar material is fed is of a size convenient to receive batches of the bentonite as required for filling the well bore 16.

At the bottom of the hopper 30, there is provided a slidable plate 36, which can be extended or retracted in order to control the size of the opening between the hoppers 30 and a screen 40 supported by side rails 18 and cross members 19 so that the rate of flow of the bentonite material 14 can be controlled, or discontinued entirely, when required.

Placed along the length of the space between side rails 18 is a screen 40. Screen 40 has openings of a size such as required to remove the fines 48 from the bentonite material 14. Generally these openings may be about ¼ inch, which has been found to comply with the most stringent code requirements which generally require a 3 minute screening period for a 50 lb. batch of bentonite. Usually, the fines are simply allowed to fall on and become blended into the surface soil adjacent to the well bore 16. However, if desired, the fines could be removed by collection thereof on a canvass or other collecting surface.

In order to ensure efficient separation through screen 40 of fines 48 and directing of the remainder of the bentonite 14 into the collecting funnel structure 11, there is provided a vibrating device 42. Vibrator 42 is preferably based on the use of a rotatable mechanism which is eccentric which thus causes vibration during rotation thereof together with the entire structure of device 10. Vibrator 42 is supported on a crossbar 44, which is, in turn, supported on two cross rails 18 by means of suitable mounting brackets 46.

In practice, the legs 20 and 22 are folded against the frame 18, and held in place either by Velcro® straps 27 or rubber cords, commonly referred to as "bungee cords", or other fastening means. Then, the apparatus 10 is erected over the abandoned well bore 16 as indicated. The side frame rails 18 are placed at a downwardly extending angle toward the chute 11 due to the differing lengths of the shorter forward legs 20 and the longer rear legs 22. These legs are adjusted to account for irregularities in the terrain surrounding the well bore 16. After the apparatus has thus been set-up in place, a suitable amount of bentonite 14 is placed in the upper hopper 32 and the vibrator motor 42 started. Generally, such a motor may be either gasoline powered or electrically powered, using a portable generator or power source available at the site. Then, the sliding flow control plate 36 is opened to commence the flow of the bentonite onto the inclined screening surface 40. The bentonite 14, with the fines 48 removed, continues its flow into the collecting chute 11, and are dropped into the well shaft 16. The procedure is continued until the well shaft is suitably packed with the bentonite. It will be apparent that, reversing the set-up steps after completion of the well sealing procedure, the apparatus 10 is readily retracted into a transport position for removal, either to storage, or another job site.

While preferred embodiments of the invention have been shown and described for purposes of illustration, it will be apparent to those skilled in the art that various other modifications may be made without departing from the spirit of the invention.

What is claimed is:

1. Apparatus for sealing of well bores comprising a hopper for dispensing comminuted well bore packing material, an inclined screening surface which removes undesired fine materials, a flow control mechanism at the bottom of said hopper for controlling flow of said comminuted material onto said screening surface, a chute for collecting material flowing off of said screening surface and directing the same into the well bore, wherein said flow control mechanism comprises a slidable plate for controlling the size of an opening between upper and lower hopper sections.

2. A process for sealing the bore of an abandoned water well comprising:

providing apparatus which includes a hopper for dispensing comminuted well bore packing material, an inclined vibratory screening surface for removing undesired fine materials, a chute for collecting material flowing from said screening surface and directing the same into a well bore, and adjustable supporting legs for supporting said apparatus in a selected stationary position, a flow control mechanism at the bottom of said hopper for controlling flow of said comminuted material onto said screening surface which includes a slidable plate for controlling the size of an opening between the bottom of said hopper and said screening surface, locating said apparatus with said chute over the well bore, adjusting the length of said legs to match the terrain surrounding said well, feeding comminuted bentonite clay material into said hopper, controlling said slidable plate to regulate the flow of said comminuted bentonite material onto said inclined screening surface, vibrating said surface to remove fine particles from said bentonite material, and directing the flow of said material with fines removed into said well.

* * * * *